US012123185B2

(12) United States Patent
Fang

(10) Patent No.: US 12,123,185 B2
(45) Date of Patent: Oct. 22, 2024

(54) TOILET BIDET DEVICE AND TOILET

(71) Applicant: Shanghai Kohler Electronics, Ltd., Shanghai (CN)

(72) Inventor: Yiguo Fang, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 19 days.

(21) Appl. No.: 18/082,990

(22) Filed: Dec. 16, 2022

(65) Prior Publication Data

US 2023/0193613 A1 Jun. 22, 2023

(30) Foreign Application Priority Data

Dec. 21, 2021 (CN) ..... 202123231743.4

(51) Int. Cl.
*E03D 9/08* (2006.01)
*A47K 13/24* (2006.01)

(52) U.S. Cl.
CPC ..... *E03D 9/08* (2013.01); *A47K 13/24* (2013.01)

(58) Field of Classification Search
CPC ..... E03D 9/08; A47K 13/24; A47K 13/12
See application file for complete search history.

(56) References Cited

U.S. PATENT DOCUMENTS 10,538,904 B2 1/2020 Tsujita
10,563,390 B2 2/2020 Schwab
10,590,639 B2 3/2020 Nogoshi et al.
10,851,533 B2 12/2020 Yaoka
10,869,583 B2 * 12/2020 Schwab ..... B65D 83/759
(Continued)

FOREIGN PATENT DOCUMENTS

CA 3061241 C 6/2022
CN 101054815 B 4/2010
(Continued)

OTHER PUBLICATIONS

Extended European Search Report from European Patent Application No. 22215465.0, dated May 22, 2023, 13 pages.

*Primary Examiner* — Christine J Skubinna
(74) *Attorney, Agent, or Firm* — Lempia Summerfield Katz LLC

(57) ABSTRACT

The application relates to a seat device and a toilet. The seat device comprises a seat having an opening, a spray pipe having a nozzle and a blocking door pivotally mounted in the seat and used for blocking the opening; the blocking door is mounted in the seat through a pivot shaft, and the blocking door is capable of rotating around the pivot shaft; the nozzle has a storage state in which the nozzle is stored in a pipe body and an extension state in which the nozzle extends out of the pipe body; when the nozzle is in the storage state, the blocking door at least partially blocks in the opening; when the nozzle is in the extension state, the nozzle holds up the blocking door to make it rotate and open the opening, and the nozzle extends out of the opening. According to the seat device and the toilet disclosed by the application, the blocking door is pivotally mounted in the seat, and in both opening and closing processes of the seat, the blocking door can block the opening of the seat, so that a structure is simplified, convenient mounting is realized, and a function of preventing water dripping is provided.

16 Claims, 10 Drawing Sheets

(56) References Cited

U.S. PATENT DOCUMENTS

| | | | | |
|---|---|---|---|---|
| 10,907,334 | B2 | 2/2021 | Yaoka | |
| 10,982,422 | B2 * | 4/2021 | Schwab | A61M 3/06 |
| 11,253,114 | B2 * | 2/2022 | Schwab | E03D 9/08 |
| 2022/0279992 | A1 | 9/2022 | Schwab | |

FOREIGN PATENT DOCUMENTS

| | | | | | |
|---|---|---|---|---|---|
| CN | 103088891 | A | | 5/2013 | |
| CN | 204849983 | U | | 12/2015 | |
| CN | 103088891 | B | | 1/2016 | |
| CN | 104674926 | B | | 8/2016 | |
| CN | 108867793 | A | | 11/2018 | |
| CN | 109457776 | A | | 3/2019 | |
| CN | 209339269 | U | | 9/2019 | |
| CN | 111622318 | A | | 9/2020 | |
| CN | 112112235 | A | | 12/2020 | |
| CN | 112112236 | A | | 12/2020 | |
| CN | 212452959 | U | | 2/2021 | |
| CN | 212534364 | U | | 2/2021 | |
| CN | 212772681 | U | | 3/2021 | |
| CN | 213233691 | U | | 5/2021 | |
| CN | 110062833 | B | | 7/2021 | |
| CN | 213805689 | U | * | 7/2021 | |
| CN | 113356320 | A | | 9/2021 | |
| CN | 215077951 | U | | 12/2021 | |
| CN | 114215149 | A | | 3/2022 | |
| CN | 216586854 | U | | 5/2022 | |
| CN | 216948611 | U | | 7/2022 | |
| CN | 116290256 | A | | 6/2023 | |
| EP | 2261428 | A1 | | 12/2010 | |
| EP | 2312068 | A1 | * | 4/2011 | E03D 9/08 |
| EP | 3346063 | A1 | | 7/2018 | |
| EP | 3542003 | A1 | | 9/2019 | |
| EP | 2261428 | B1 | | 8/2022 | |
| EP | 3485103 | B1 | | 9/2022 | |
| JP | 5928440 | B2 | | 5/2016 | |
| TW | I332538 | B | | 11/2010 | |
| TW | I653378 | B | | 3/2019 | |
| TW | I666365 | B | | 7/2019 | |

* cited by examiner

TOILET BIDET DEVICE AND TOILET

CROSS REFERENCE TO RELATED APPLICATION

This application claims the benefit of priority to: Chinese Patent Application No. 202123231743.4 filed in the Chinese Intellectual Property Office on De. 21, 2021, which is hereby incorporated by reference in its entirety.

FIELD

The present disclosure relates to the field of toilet technologies, and particularly to a toilet bidet device and a toilet.

BACKGROUND

A smart toilet may be provided with a spray pipe in a bidet, a telescopic nozzle is arranged in the spray pipe, and an opening is formed in an inner side of the bidet for the nozzle to extend out for liquid spraying. A blocking door is usually mounted in the opening of the bidet to close the opening. The bidet on a ceramic body of the toilet may be turned to open and close, so that it is necessary to arrange a special holding mechanism on the blocking door to hold the blocking door and thus avoid the blocking door from being automatically opened when the bidet is turned up. Moreover, a cavity of the bidet is very small, so it is difficult to arrange the holding mechanism.

In view of the above technical problems, it is necessary to provide a novel bidet device and a toilet.

SUMMARY

The present disclosure aims to overcome the defects in the art and provide a bidet device and a toilet. In the bidet device and the toilet, a blocking door is mounted in a bidet through a pivot shaft, without a need to specifically arrange a holding mechanism. Thus, a structure can be simplified and a convenient mounting can be realized.

The present disclosure provides a bidet device. The bidet device comprises a bidet having an opening, a spray pipe having a nozzle, and a blocking door pivotally mounted in the bidet and configured to block the opening.

The spray pipe is mounted in a cavity at a front end of the bidet, and the opening is formed in an inner side wall at the front end of the bidet.

The blocking door is mounted in the bidet through a pivot shaft, and the blocking door is configured to rotate around the pivot shaft.

The nozzle has a storage state in which the nozzle is stored in a pipe body and an extension state in which the nozzle extends out of the pipe body.

When the nozzle is in the storage state, the blocking door at least partially blocks in the opening.

When the nozzle is in the extension state, the nozzle holds up the blocking door to make it rotate and open the opening, and the nozzle extends out of the opening.

In an embodiment, the bidet is provided with a bottom plate and a top plate, which are opposite to each other.

The pivot shaft is mounted on an end portion of the pipe body close to a pipe orifice, and the pivot shaft is located between an axis of the pipe body and the top plate.

The blocking door is a curved plate or a bent plate, and when the nozzle is in the storage state, the blocking door is at least partially located in the opening.

In an embodiment, when the nozzle is in the storage state and the bidet is in a turning state, the blocking door is at least partially kept in the opening.

In an embodiment, the blocking door comprises a first end plate, an intermediate plate and a second end plate, which are connected in sequence.

The first end plate and the second end plate are respectively connected at both ends of the intermediate plate, and the first end plate and the second end plate respectively extend obliquely from the intermediate plate to the pipe body.

The intermediate plate is connected to the pivot shaft.

When the nozzle is in the storage state, the first end plate and/or the intermediate plate is at least partially located in the opening.

In an embodiment, the first end plate, the intermediate plate, and the second end plate are respectively connected to a baffle at both sides.

A water receiving groove is formed among the first end plate, the intermediate plate, the second end plate, and the two baffles.

The bidet is provided with a turn-up ending position on a ceramic body of a toilet.

When the bidet is located in the turn-up ending position, the nozzle is in the storage state, and the water receiving groove is located below the pipe orifice of the pipe body.

In an embodiment, when the bidet is located in the turn-up ending termination position, the intermediate plate is in a horizontal state.

In an embodiment, a limiting boss is arranged in the cavity of the bidet.

When the bidet is located at the turn-up ending position, the second end plate is overlapped on the limiting boss.

In an embodiment, the first end plate, the intermediate plate, the second end plate, and the baffles are integrally formed.

In an embodiment, the blocking door is provided with connecting lug plates at both sides, two connecting lug plates are located on two opposite sides of the pipe body, and the connecting lug plates are connected to the pivot shaft.

The present disclosure provides a toilet, which comprises the bidet device according to any one of the technical solutions above.

The present disclosure has the following beneficial effects.

According to the bidet device and the toilet of the present disclosure, the blocking door is mounted in the cavity at the front end of the bidet through the pivot shaft, and the blocking door may self-adaptively rotate under an action of gravity. Thus, in both opening and closing operations of the bidet, the blocking door can block the opening of the bidet, without a need to specially arrange a holding mechanism, so that a structure can be simplified and a convenient mounting can be realized.

The water receiving groove is formed on one side of the blocking door oriented to the spray pipe, and after the bidet is turned up, the water receiving groove may receive water dripping from the spray pipe. Thus, the water can be prevented from dripping on the ceramic body of the toilet.

BRIEF DESCRIPTION OF THE FIGURES

With reference to the drawings, the contents disclosed by the present disclosure should be more easily understood. It should be understood that these drawings are merely used for illustration and are not intended to limit the protection scope of the present disclosure. In the drawings.

DETAILED DESCRIPTION

Figure 1:
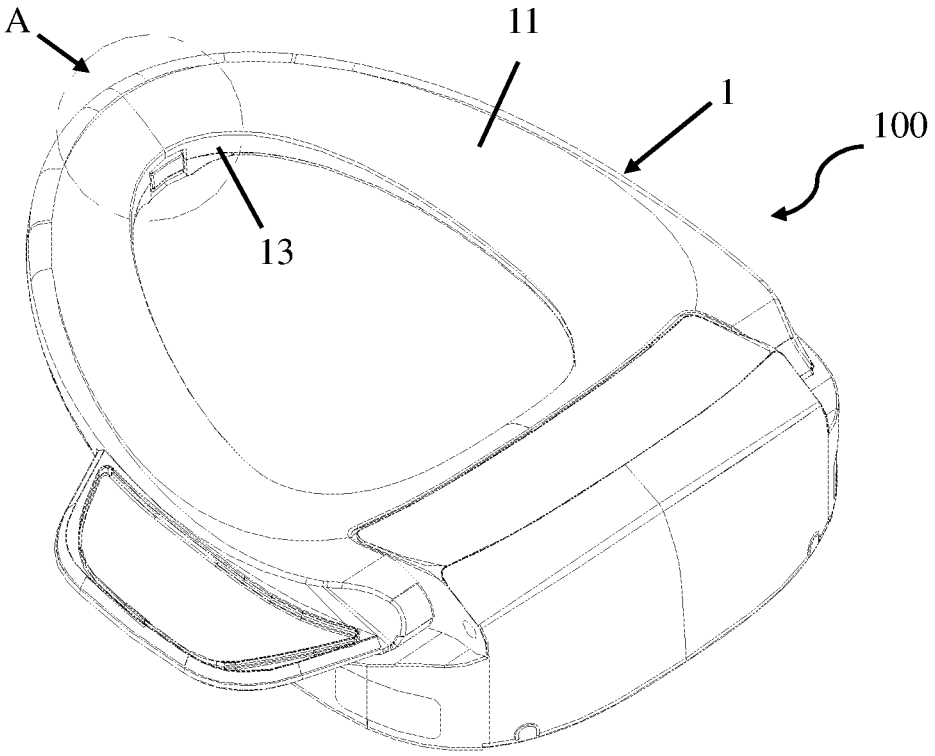
FIG. 1 is a diagram of a bidet device according to an example of the present disclosure when an opening is closed by a blocking door.

The specific embodiments of the present disclosure are further described with reference to the drawings hereinafter. Same or equivalent parts are denoted by same reference numerals. It should be noted that the terms "front", "back", "left", "right", "up" and "down" used in the following description refer to the directions in the drawings, and the terms "inner" and "outer" refer to the directions towards or far away from geometric centers of specific parts respectively.

Figure 2:
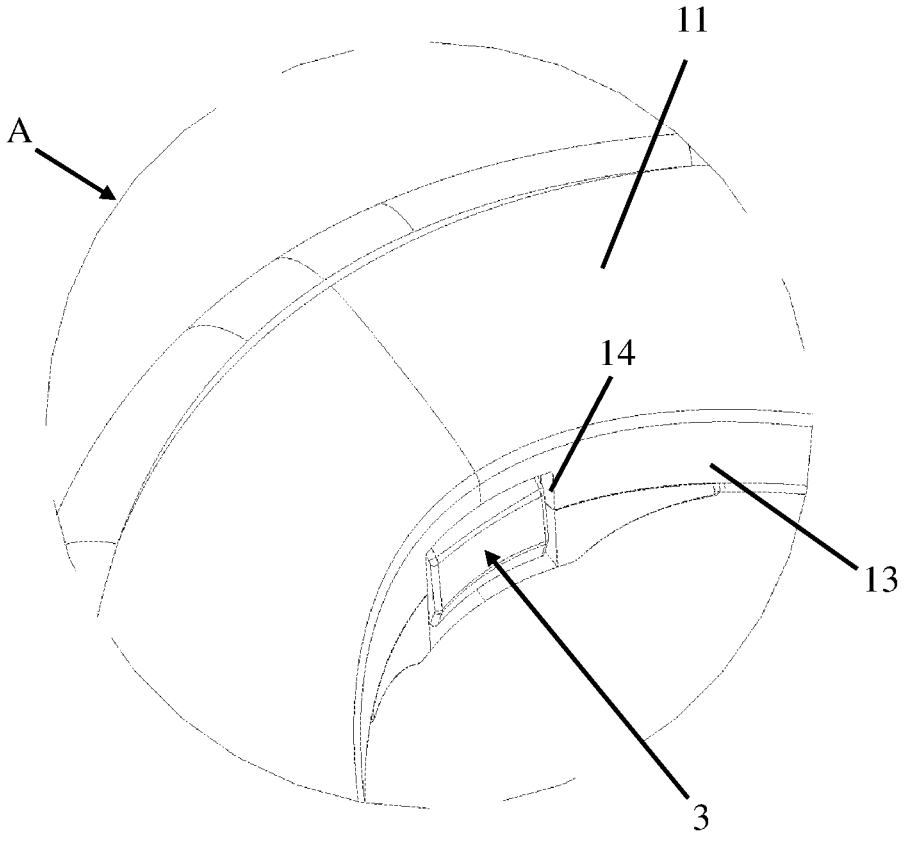
FIG. 2 is an enlarged view of an A area in FIG. 1.
Figure 3:
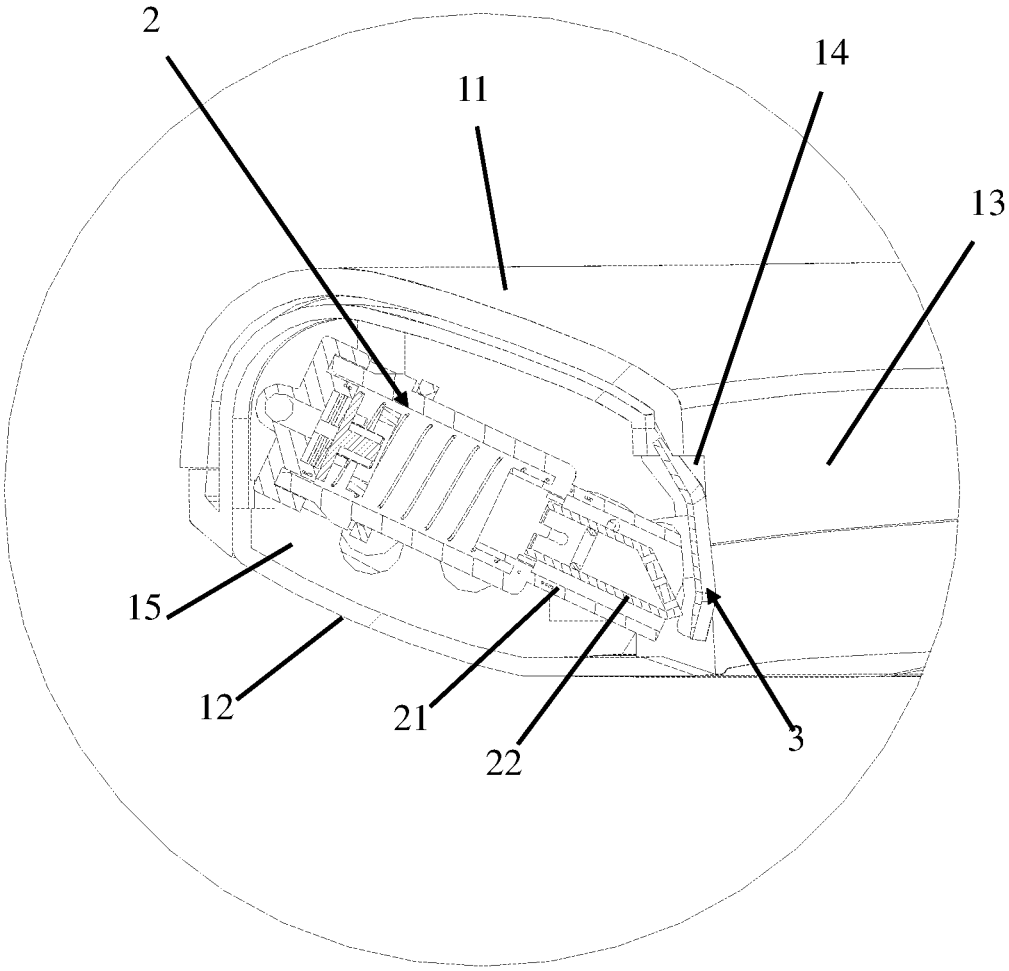
FIG. 3 is a sectional view of a spray pipe mounted in a mounting cavity of a bidet when the opening is closed by the blocking door.
Figure 4:
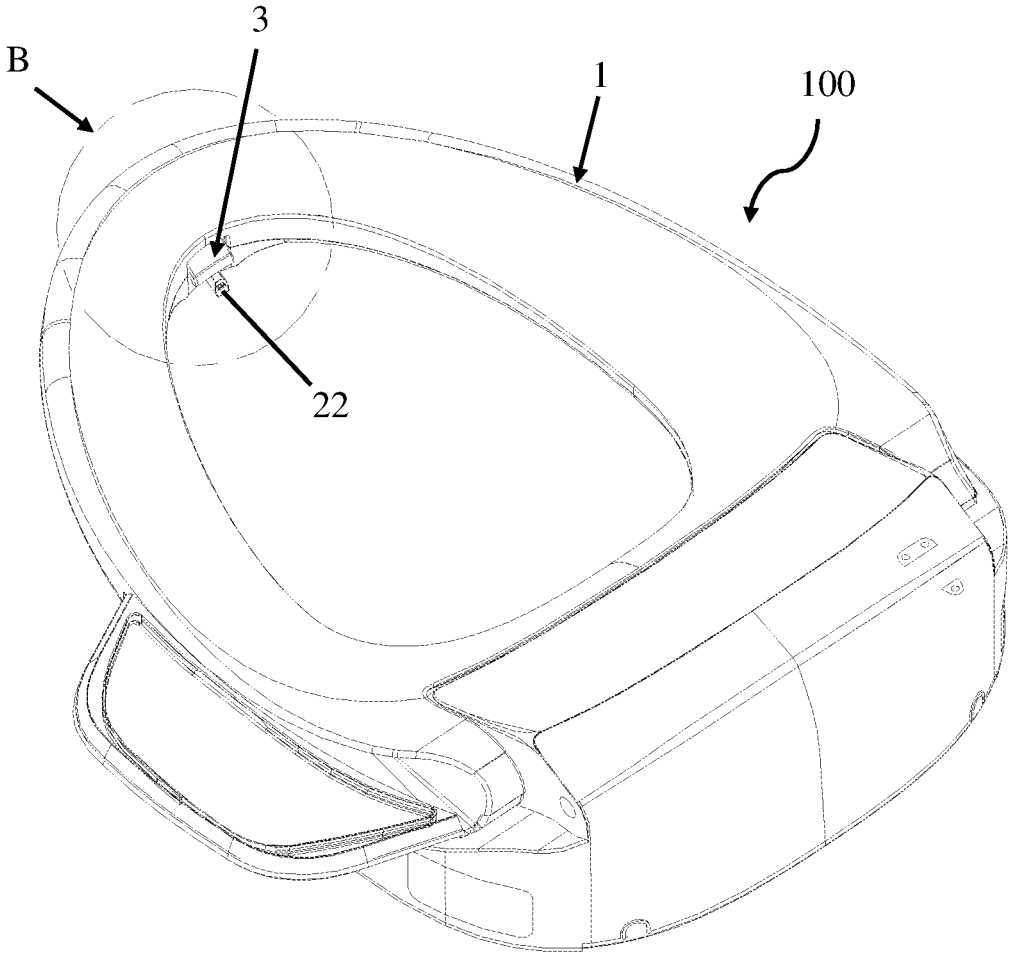
FIG. 4 is a diagram of the bidet device according to an example of the present disclosure when the nozzle extends out.
Figure 5:
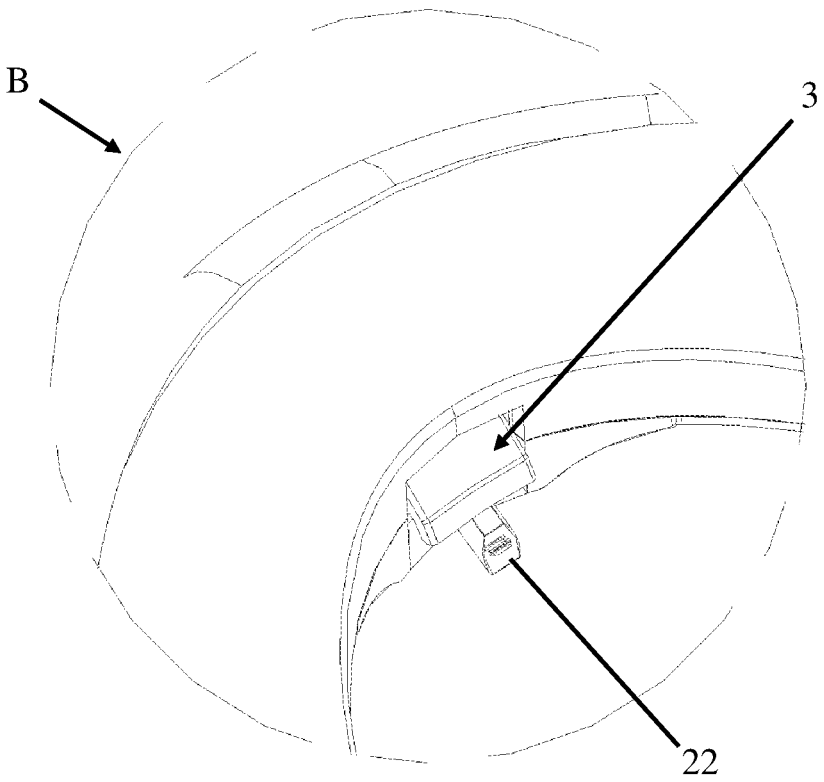
FIG. 5 is an enlarged view of a B area in FIG. 4.
Figure 6:
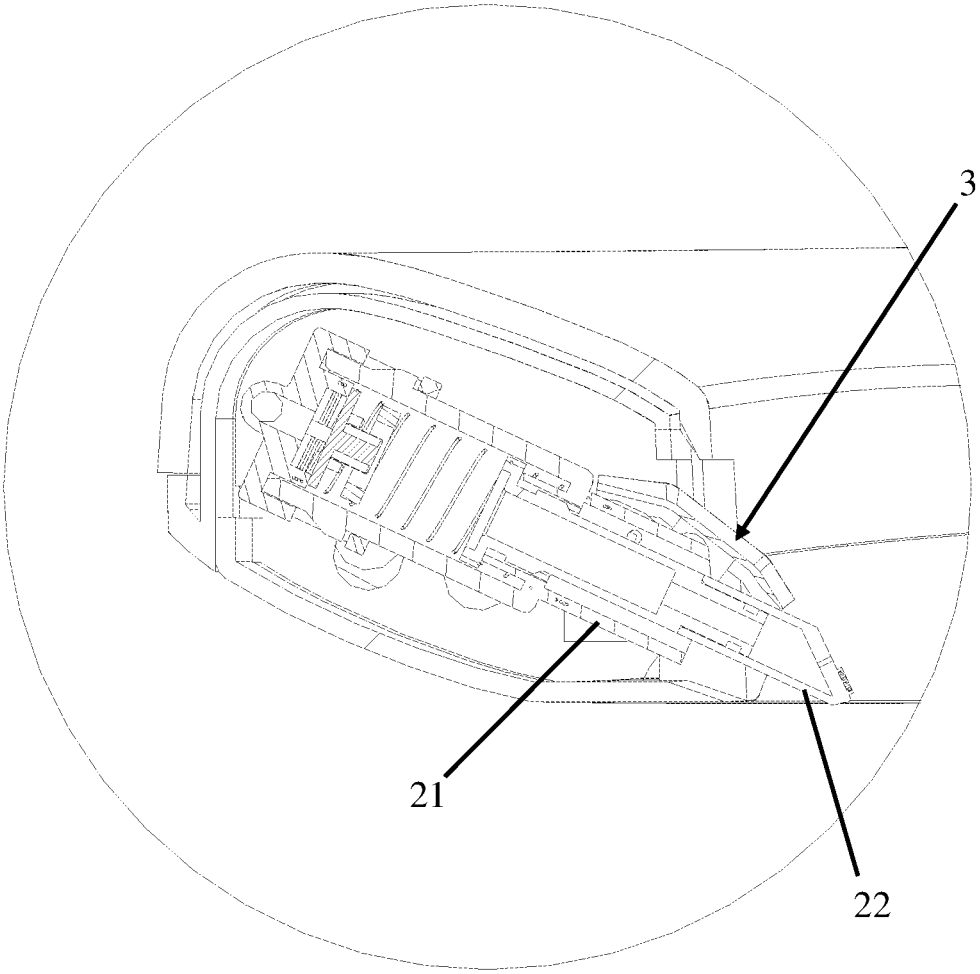
FIG. 6 is a sectional view of the spray pipe mounted in the mounting cavity of the bidet when the nozzle extends out of the opening.
Figure 7:
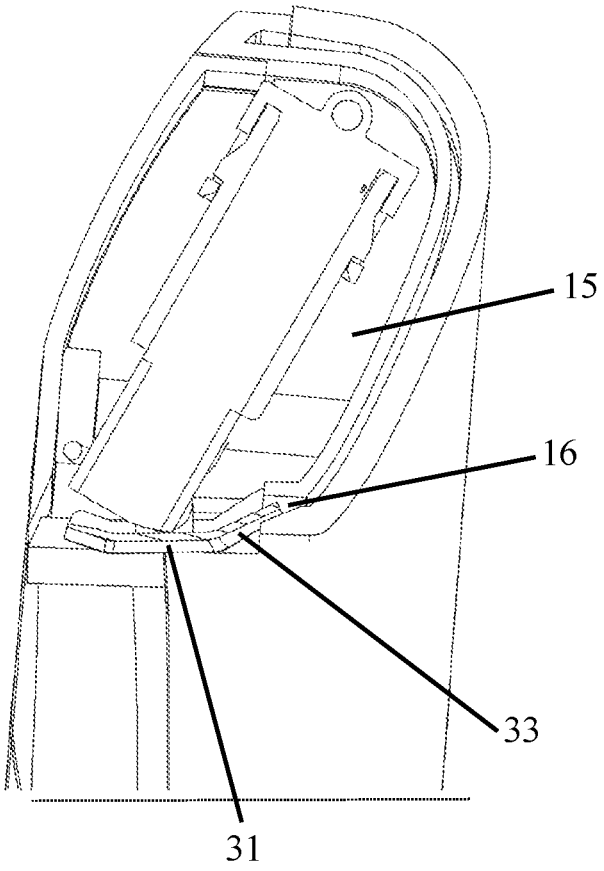
FIG. 7 is a schematic diagram of positions of the spray pipe and the blocking door when the bidet is turned to a turn-up ending position.
Figure 8:
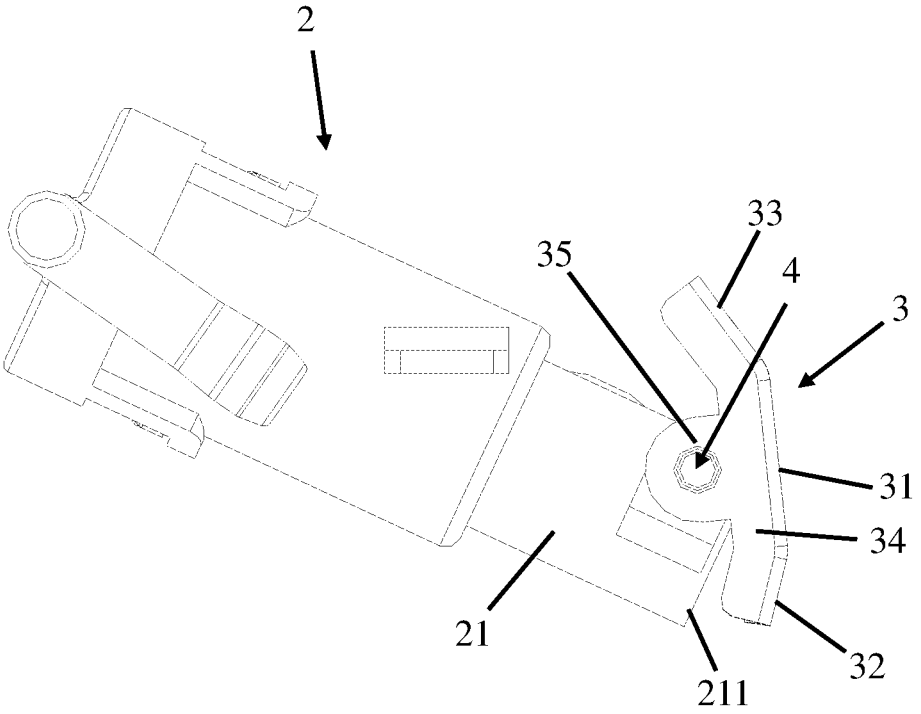
FIG. 8 is a diagram of the blocking door mounted on the spray pipe through a pivot shaft.
Figure 9:
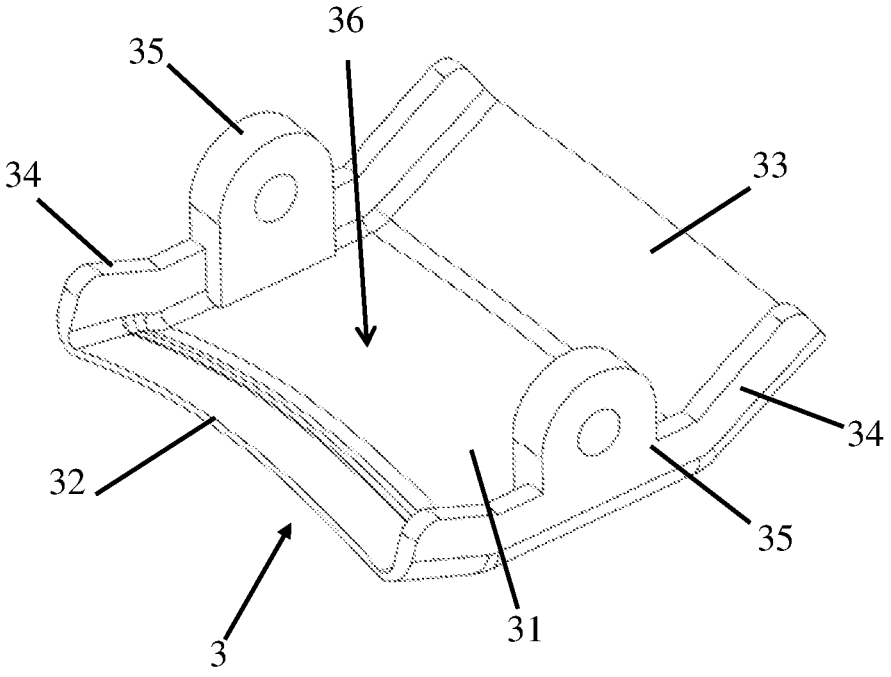
FIG. 9 is a diagram of the blocking door.

FIG. 1 is a diagram of a bidet device according to an example of the present disclosure when an opening is closed by a blocking door. FIG. 2 is an enlarged view of an A area in FIG. 1. FIG. 3 is a sectional view of a spray pipe mounted in a mounting cavity of a bidet when the opening is closed by the blocking door. FIG. 4 is a diagram of the bidet device according to an example of the present disclosure when the nozzle extends out. FIG. 5 is an enlarged view of a B area in FIG. 4. FIG. 6 is a sectional view of the spray pipe mounted in the mounting cavity of the bidet when the nozzle extends out of the opening. FIG. 7 is a schematic diagram of positions of the spray pipe and the blocking door when the bidet is turned to a turn-up ending position. FIG. 8 is a diagram of the blocking door mounted on the spray pipe through a pivot shaft. FIG. 9 is a diagram of the blocking door. As shown in FIG. 1-FIG. 9, a bidet device 100 according to an embodiment of the present disclosure comprises a bidet 1 having an opening 14, a spray pipe 2 having a nozzle 22, and a blocking door 3 pivotally mounted in the bidet 1 and configured to block the opening 14.

The spray pipe 2 is mounted in a cavity 15 at a front end of the bidet 1, and the opening 14 is formed in an inner side wall 13 at the front end of the bidet 1.

The blocking door 3 is mounted in the bidet 1 through a pivot shaft 4, and the blocking door 3 is configured to rotate around the pivot shaft 4.

The nozzle 22 has a storage state in which the nozzle 22 is stored in a pipe body 21 and an extension state in which the nozzle 22 extends out of the pipe body 21.

When the nozzle 22 is in the storage state, the blocking door 3 at least partially blocks in the opening 14.

When the nozzle 22 is in the extension state, the nozzle 22 holds up the blocking door 3 and enables the blocking door 3 to rotate so as to open the opening 14, and the nozzle 22 then may extends out of the opening 14.

The bidet device 100 according to the present disclosure comprises the bidet 1, the spray pipe 2, the blocking door 3, and the pivot shaft 4.

Figure 10:
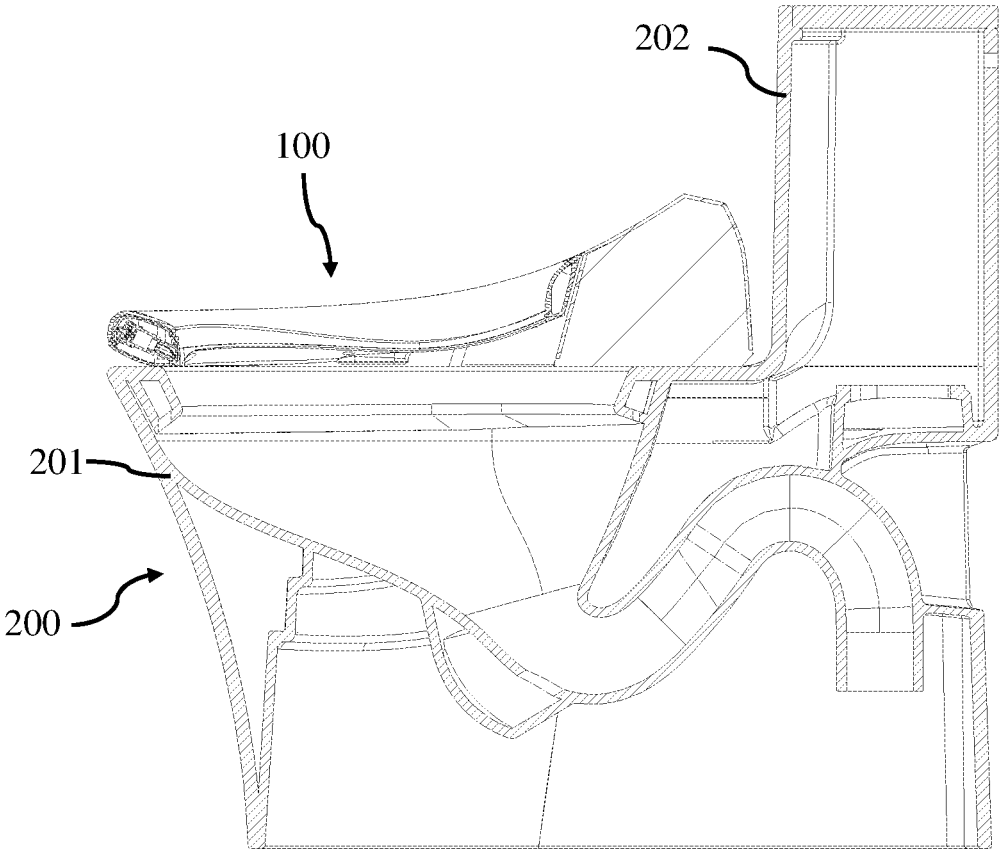
FIG. 10 is a sectional view of a toilet according to an example of the present disclosure.

With reference to FIG. 10, a rear end of the bidet 1 is a mounting end for being mounted on a ceramic body 201 of a toilet 200, and the front end of the bidet 1 is an end opposite to the mounting end. The bidet 1 comprises a top plate 11, a bottom plate 12, an inner side wall 13, and an outer side wall. When the bidet 1 is covered on the ceramic body 201, the bottom plate 12 is contacted with the ceramic body 201, the top plate 11 is located above, and the inner side wall 13 faces a through hole of the bidet 1. The top plate 11, the bottom plate 12, the inner side wall 13, and the outer side wall enclose and form a cavity 15 between them.

The spray pipe 2 is mounted in the cavity 15 at the front end of the bidet 1. The spray pipe 2 comprises a pipe body 21 and the nozzle 22, and the nozzle 22 is slidably connected to the pipe body 21. A driving mechanism configured to drive the nozzle 22 to extend and retract is connected between the pipe body 21 and the nozzle 22. The driving mechanism may be an air cylinder, an oil cylinder, or the like. The nozzle 22 may be stored in the pipe body 21 and may also extend out of a pipe orifice 211 of the pipe body 21. The pipe body 21 is mounted in the cavity 15 through a mounting shaft. The pipe orifice 211 of the pipe body 21 is oriented to the inner side wall 13 of the bidet 1.

The opening 14 is formed in the inner side wall 13 of the bidet 1 at a position corresponding to the pipe orifice 211 and configured to the nozzle 22 to extend out and spray a liquid to clean private parts of human body.

The pivot shaft 4 may be mounted in the bidet 1 close to the opening 14. For example, the pivot shaft 4 may be mounted on the top plate 11 or the bottom plate 12 of the bidet 1.

The pivot shaft 4 may also be mounted at the end of the pipe body 21 close to the pipe orifice 211, and left and right sides of the pipe body 21 are respectively provided with one pivot shaft 4.

The blocking door 3 is connected to the pivot shaft 4, and the blocking door 3 may rotate around the pivot shaft 4. A main part of the blocking door 3 is located in the cavity 15 at the front end of the bidet 1, and a part of the blocking door 3 blocks the front side of the pipe orifice 211.

When the nozzle 22 is stored in the pipe body 21, a part of the blocking door 3 is located in the opening 14, so as to play the role in blocking the opening 14 or closing the opening 14.

When the nozzle 22 extends out of the pipe body 21, the nozzle 22 may hold up or push the blocking door 3 to make the blocking door 3 rotate around the pivot shaft 4 and so as to open the opening 14, and the nozzle 22 finally extends out of the opening 14.

An area of the blocking door 3 is much larger than that of the opening 14, and in a process of turning the bidet 1, the blocking door 3 may automatically rotate around the pivot shaft 4 under an action of self-gravity, so that a part of the blocking door can always block the opening 14.

Therefore, according to the bidet device according to the present disclosure, the blocking door 3 is mounted in the cavity 15 at the front end of the bidet 1 through the pivot shaft 4, and the blocking door 3 may self-adaptively rotate under an action of gravity, so that in both opening and closing processes of the bidet 1, the blocking door 3 can block the opening 14 of the bidet 1, without a need to specially arrange a holding mechanism, so that a structure can be simplified and a convenient mounting can be realized.

In an embodiment, as shown in FIG. 3, FIG. 6, FIG. 8, and FIG. 9, the bidet 1 is provided with the bottom plate 12 and the top plate 11, which are opposite to each other.

The pivot shaft 4 is mounted on an end portion of the pipe body 21 close to the pipe orifice 211, and the pivot shaft 4 is located between an axis of the pipe body 21 and the top plate 11.

The blocking door 3 is a curved plate or a bent plate. When the nozzle 22 is in the storage state, the blocking door 3 is at least partially located in the opening 14.

In the embodiment, the blocking door 3 may have a concave curved surface structure. Alternatively, the blocking door 3 may have a two-stage structure or a multi-stage structure, and a groove may be formed in an intermediate or middle section of the blocking door 3.

Such arrangement is convenient for the blocking door 3 to enter the opening 14 to block the opening 14.

In an embodiment, as shown in FIG. 1-FIG. 3 and FIG. 7, when the nozzle 22 is in the storage state and the bidet 1 is in a turning state, the blocking door 3 is at least partially kept in the opening 14. No matter how the bidet 1 is turned, the blocking door 3 can always block the opening 14 and thus a good decorative effect can be achieved.

A center of gravity of the blocking door 3 is offset or disposed at a side of the pivot shaft 4 away from the opening 14. A length or a thickness of plates on two sides of the pivot shaft 4 may be realized, so that the end portion of the blocking door 3 oriented to the opening 14 can be kept in the opening 14.

In an embodiment, as shown in FIG. 3, FIG. 8, and FIG. 9, the blocking door 3 comprises a first end plate 32, an intermediate plate 31, and a second end plate 33, which are connected in sequence.

The first end plate 32 and the second end plate 33 are respectively connected to both ends of the intermediate plate 31, and the first end plate 32 and the second end plate 33 respectively extend obliquely from the intermediate plate 31 to the pipe body 21.

The intermediate plate 31 is connected to the pivot shaft 4.

When the nozzle 22 is in the storage state, the first end plate 32 and/or the intermediate plate 31 is at least partially located in the opening 14.

In the embodiment, the blocking door 3 is formed by sequentially connecting the first end plate 32, the intermediate plate 31, and the second end plate 33. Thus, the blocking door 3 is a bent plate. The first end plate 32 and the second end plate 33 extend obliquely to the same side of the intermediate plate 31, so that the blocking door 3 can cover the pipe orifice 211, and the first end plate 32 and/or the intermediate plate 31 may be at least partially located in the opening 14 to cover or block the opening 14.

In the embodiment, the center of gravity of the blocking door 3 is offset or disposed on one side close to the second end plate 33, which may be realized by making the second end plate 33 longer than the first end plate 32 or making the second end plate 33 heavier than the first end plate 32. Such an arrangement may ensure that the first end plate 32 can be kept in the opening 14.

In one embodiment, as shown in FIG. 8 and FIG. 9, two sides of the first end plate 32, the intermediate plate 31, and the second end plate 33 are respectively connected to a baffle 34.

A water receiving groove 36 is formed among or by the first end plate 32, the intermediate plate 31, the second end plate 33, and two baffles 34.

FIG. 10 is a sectional view of a toilet according to an example of the present disclosure. With reference to FIG. 10, the bidet 1 is provided with a turn-up ending position with respect to the ceramic body 201 of the toilet 200.

When the bidet 1 is in the turn-up ending position, the nozzle 22 is in the storage state, and the water receiving groove 36 is located below the pipe orifice 211 of the pipe body 21.

When the bidet 1 is in the turn-up ending position, a rotation angle resulted from the turning motion is about 90° to 115°, and the bidet 1 can be turned to a water tank 202.

When the pipe orifice 211 is oriented downwardly, the water receiving groove 36 is located below the pipe orifice 211 for receiving water dripping from the pipe orifice 211. Thus, the water may be prevented from dripping on the ceramic body. After the bidet 1 covers the ceramic body 201, the water may flow from the water receiving groove 36 into a water cavity of the ceramic body 201 along the first end plate 32 and through the opening 14.

In one embodiment, as shown in FIG. 7, when the bidet 1 is located in the turn-up ending position, the intermediate plate 31 is in a horizontal state. At the moment, the first end plate 32 and the second end plate 33 both extend upwardly and extend obliquely away from the intermediate plate 31. Thus, the water can be effectively prevented from flowing out of the water receiving groove 36.

In one embodiment, as shown in FIG. 7, a limiting boss 16 is arranged in the cavity 15 of the bidet 1. When the bidet 1 is located in the turn-up ending position, the second end plate 33 is overlapped on the limiting boss 16.

The limiting boss 16 stops the second end plate 33 for keep the intermediate plate 31 in the horizontal state, and when the bidet 1 is turned forward, the second end plate 33 automatically leaves the limiting boss 16.

In one embodiment, the first end plate 32, the intermediate plate 31, the second end plate 33, and the baffle 34 are integrally formed. This is convenient for machining, manufacturing, and molding and achieves a high structural strength.

In one embodiment, as shown in FIG. 8 and FIG. 9, the blocking door 3 is provided with connecting lug plates 35 on both sides, two connecting lug plates 35 are located on two opposite sides of the pipe body 21, and the connecting lug plates 35 are connected to the pivot shaft 4.

The connecting lug plates 35 may be integrally formed with the baffle 34, and each of the two connecting lug plates 35 is provided with a through hole for the pivot shaft 4 to penetrate through. This is convenient for the blocking door 3 to assemble with the pipe body 21 or a housing of the bidet 1.

As shown in FIG. 10, an embodiment of the present disclosure provides the toilet 200. The toilet 200 comprises the bidet device 100 according to any embodiments as described above.

In an embodiment, the toilet 200 includes a base (e.g., a pedestal, bowl, etc.) and a tank. The base is configured to be attached to another object such as a drainpipe, floor, or another suitable object. The base includes a bowl, a sump (e.g., a receptacle) disposed below the bowl, and a trapway fluidly connecting the bowl to a drainpipe or sewage line. The tank may be supported by the base, such as an upper surface of a rim. The tank may be integrally formed with the base as a single unitary body. In other embodiments, the tank may be formed separately from the base and coupled (e.g., attached, secured, fastened, connected, etc.) to the base. The toilet may further include a tank lid covering an opening and inner cavity in the tank. The toilet may include a seat assembly including a seat and a seat cover rotatably coupled to the base. The toilet may further include a hinge assembly.

In another embodiment, the toilet may be a tankless toilet. The toilet includes a base and a seat assembly coupled to the base. The base includes a bowl, a sump disposed below the bowl, and a trapway fluidly connecting the bowl to a drainpipe or sewage line. The toilet includes a waterline that supplies the toilet with water. The toilet may further include a seat assembly including a seat and a seat cover rotatably coupled to the base. The toilets described above are provided herein as non-limiting examples of toilets that may be configured to utilize aspects of the present disclosure.

In some examples, the bidet may be included in a seat or pedestal of a toilet. In other examples, the bidet may be manufactured separately from and attached or coupled to a seat or pedestal of a toilet. The bidet includes a housing. The housing is configured to receive a flow of water through a housing inlet and dispense the flow of water from a housing outlet. The housing inlet and housing outlet may be located on opposite ends of the housing from one another, such that water may flow through the housing from the housing inlet to the housing outlet. In some examples, the housing further includes a chamber. As the housing receives the flow of water, the chamber may fill with water and provide a flow of water between the housing inlet and the housing outlet. The chamber may be configured to contain the flow of water and direct the flow of water from the housing inlet to the housing outlet. After the chamber has filled with water, the flow of water may travel along a substantially linear path between the housing inlet and the housing outlet. In some examples, one or more walls within the housing may be included to help direct a flow of water between the housing inlet and the housing outlet. The bidet may further include a housing inlet conduit configured to direct a flow of water to the housing inlet. The housing inlet conduit may be coupled to a water supply such as tank or waterline. The housing may further include a gear assembly or a portion of the gear assembly.

A rear end (i.e., the mounting end) of the bidet 1 in the bidet device 100 is mounted on a rear end portion of the ceramic body 201 through a rotating shaft.

The structure, construction, and working principle of the bidet device 100 refer to the foregoing description of the bidet device 100 and thus are not repeated herein.

To sum up, according to the bidet device and the toilet according to the present disclosure, the blocking door 3 is pivotally mounted in the cavity 15 at a front end of the bidet 1. In both opening and closing operations of the bidet 1, the blocking door 3 can at least partially block the opening 14 of the bidet 1, so that a structure can be simplified and a convenient mounting can be realized. The water receiving groove 36 is formed at the side of the blocking door 3 facing the spray pipe 2 and can prevent water in the spray pipe 2 from dripping on the ceramic body 201 of the toilet 200 when the bidet 1 is opened or turned up.

Figure 11:
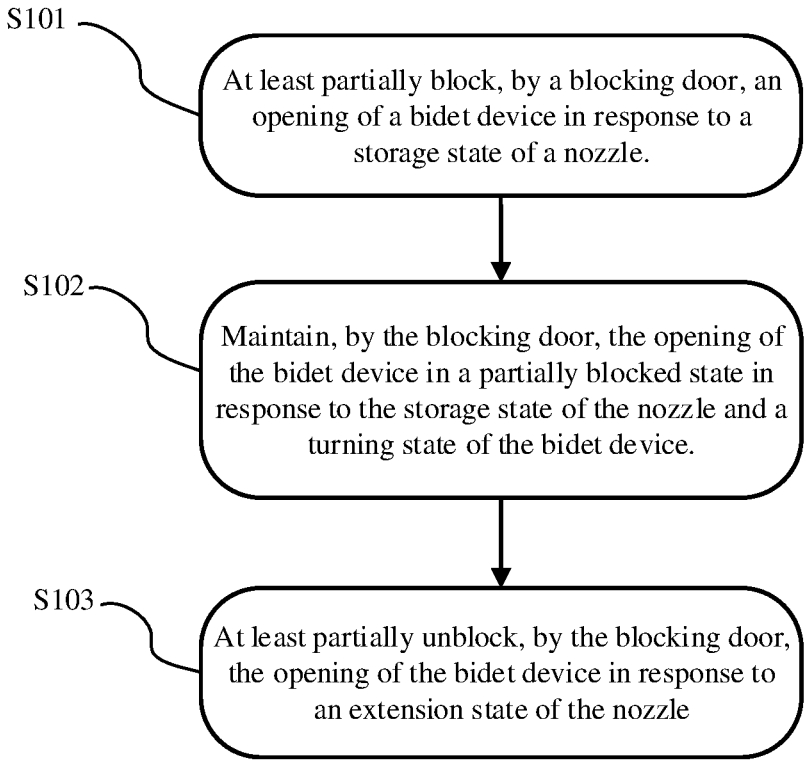
FIG. 11 is a flow chart of a method for controlling a bidet device according to an example of the present disclosure.

FIG. 11 is a flow chart of a method for controlling a bidet device according to an example of the present disclosure. The bidet device controlled by the method may be the bidet device according to any of the foregoing embodiments and may be configured to perform an operation, function, or the like as described in the present disclosure.

At act S101, the blocking door 3 at least partially blocks the opening 14 of the bidet device 100 in response to the storage state of the nozzle 22. In the storage state, the nozzle 22 is retracted into the pipe body 21 of the bidet device 100.

At act S102, the blocking door 3 maintains the opening 14 of the bidet device 100 in a partially blocked state in response to the storage state of the nozzle 22 and a turning state of the bidet device 100. In the turning state of the bidet device 100, the bidet device 100 is flipped upwards or downwards.

At act S103, the blocking door at least partially unblocks the opening 14 of the bidet device 100 in response to the extension state of the nozzle 22. In the extension state, the nozzle 22 extends from the pipe body 21 of the bidet device 100 via the opening 14 of the bidet device 100. When the nozzle 22 extends from the pipe body 21 of the bidet device 100, the nozzle pushes the blocking door 3 to rotate around the pivot shaft 4 so as to at least partially unblock the opening 14 of the bidet device 100.

The acts S101, S102, and S103 in the method for controlling the bidet device may be performed in any sequences as long as the corresponding condition occurs.

The above technical solutions may be combined as required to achieve the best technical effect.

The above are merely the principle and the embodiments of the present disclosure. It should be pointed out that, for those of ordinary skill in the art, several other modifications may be made based on the principle of the present disclosure and should also be regarded as falling within the protection scope of the present disclosure.

I claim:

1. A seat device, comprising a seat having an opening, a spray pipe having a nozzle and a blocking door pivotally mounted in the seat and used for blocking the opening, wherein:

the spray pipe is mounted in a cavity at a front end of the seat, and the opening is formed in an inner side wall at the front end of the seat;

the blocking door is mounted in the seat through a pivot shaft, and the blocking door is capable of rotating around the pivot shaft;

the nozzle has a storage state in which the nozzle is stored in a pipe body and an extension state in which the nozzle extends out of the pipe body;

when the nozzle is in the storage state, the blocking door at least partially blocks in the opening;

when the nozzle is in the extension state, the nozzle holds up the blocking door to make it rotate and open the opening, thereby the nozzle may extend out of the opening;

wherein the seat is provided with a bottom plate and a top plate which are opposite to each other;

the pivot shaft is mounted on an end portion of the pipe body close to a pipe orifice, and the pivot shaft is located between an axis of the pipe body and the top plate;

the blocking door is a curved plate or a bent plate, and when the nozzle is in the storage state, the blocking door is at least partially located in the opening;

wherein when the nozzle is in the storage state and the seat is in a turning state, the blocking door is at least partially kept in the opening;

wherein the blocking door comprises a first end plate, an intermediate plate and a second end plate which are connected in sequence;

the first end plate and the second end plate are connected to two ends of the intermediate plate, and the first end plate and the second end plate respectively extend obliquely from the intermediate plate to the nozzle;

the intermediate plate is connected with the pivot shaft; and when the nozzle is in the storage state, the first end plate and/or the intermediate plate is at least partially located in the opening.

2. The seat device according to claim 1, wherein both sides of the first end plate, the intermediate plate and the second end plate are respectively connected with a baffle;

a water receiving groove is formed between the first end plate, the intermediate plate, the second end plate and two said baffles;

the seat is provided with a turn ending position on a ceramic body of a toilet; and when the seat is located in the turn ending position, the nozzle is in the storage state, and the water receiving groove is located below the pipe orifice of the pipe body.

3. The seat device according to claim 2, wherein when the seat is located in the turn ending position, the intermediate plate is in a horizontal state.

4. The seat device according to claim 3, wherein a limiting boss is arranged in the cavity of the seat; and when the seat is located in the turn ending position, the second end plate is overlapped on the limiting boss.

5. The seat device according to claim 2, wherein the first end plate, the intermediate plate, the second end plate and the baffles are integrally formed.

6. The seat device according to claim 1, wherein the blocking door is provided with connecting lug plates at both sides, two connecting lug plates are located on two opposite sides of the pipe body, and the connecting lug plates are connected with the pivot shaft.

7. The seat device according to claim 2, wherein the blocking door is provided with connecting lug plates at both sides, two connecting lug plates are located on two opposite sides of the pipe body, and the connecting lug plates are connected with the pivot shaft.

8. The seat device according to claim 3, wherein the blocking door is provided with connecting lug plates at both sides, two connecting lug plates are located on two opposite sides of the pipe body, and the connecting lug plates are connected with the pivot shaft.

9. A toilet comprising:

a bowl;

a seat device, comprising a seat having an opening, a spray pipe having a nozzle and a blocking door pivotally mounted in the seat and used for blocking the opening, wherein:

the spray pipe is mounted in a cavity at a front end of the seat, and the opening is formed in an inner side wall at the front end of the seat;

the blocking door is mounted in the seat through a pivot shaft, and the blocking door is capable of rotating around the pivot shaft;

the nozzle has a storage state in which the nozzle is stored in a pipe body and an extension state in which the nozzle extends out of the pipe body;

when the nozzle is in the storage state, the blocking door at least partially blocks in the opening;

when the nozzle is in the extension state, the nozzle holds up the blocking door to make it rotate and open the opening, thereby the nozzle may extend out of the opening;

wherein the seat is provided with a bottom plate and a top plate which are opposite to each other;

the pivot shaft is mounted on an end portion of the pipe body close to a pipe orifice, and the pivot shaft is located between an axis of the pipe body and the top plate;

the blocking door is a curved plate or a bent plate, and when the nozzle is in the storage state, the blocking door is at least partially located in the opening;

wherein when the nozzle is in the storage state and the seat is in a turning state, the blocking door is at least partially kept in the opening;

wherein the blocking door comprises a first end plate, an intermediate plate and a second end plate which are connected in sequence;

the first end plate and the second end plate are connected to two ends of the intermediate plate, and the first end plate and the second end plate respectively extend obliquely from the intermediate plate to the nozzle;

the intermediate plate is connected with the pivot shaft; and when the nozzle is in the storage state, the first end plate and/or the intermediate plate is at least partially located in the opening.

10. The seat device according to claim 9, wherein both sides of the first end plate, the intermediate plate and the second end plate are respectively connected with a baffle;

a water receiving groove is formed between the first end plate, the intermediate plate, the second end plate and two said baffles;

the seat is provided with a turn ending position on a ceramic body of a toilet; and when the seat is located in the turn ending position, the nozzle is in the storage state, and the water receiving groove is located below the pipe orifice of the pipe body.

11. The seat device according to claim 10, wherein when the seat is located in the turn ending position, the intermediate plate is in a horizontal state.

12. The seat device according to claim 11, wherein a limiting boss is arranged in the cavity of the seat; and when the seat is located in the turn ending position, the second end plate is overlapped on the limiting boss.

13. The seat device according to claim 11, wherein the first end plate, the intermediate plate, the second end plate and the baffles are integrally formed.

14. The seat device according to claim 10, wherein the blocking door is provided with connecting lug plates at both sides, two connecting lug plates are located on two opposite sides of the pipe body, and the connecting lug plates are connected with the pivot shaft.

15. The seat device according to claim 11, wherein the blocking door is provided with connecting lug plates at both sides, two connecting lug plates are located on two opposite sides of the pipe body, and the connecting lug plates are connected with the pivot shaft.

16. The seat device according to claim 12, wherein the blocking door is provided with connecting lug plates at both sides, two connecting lug plates are located on two opposite sides of the pipe body, and the connecting lug plates are connected with the pivot shaft.

* * * * *